United States Patent [19]

Bertell

[11] 4,409,113

[45] Oct. 11, 1983

[54] SYNTHETIC HOT FORGING LUBRICANTS AND PROCESS

[75] Inventor: Jerome W. Bertell, South Holland, Ill.

[73] Assignee: Pennwalt Corporation, Philadelphia, Pa.

[21] Appl. No.: 317,206

[22] Filed: Nov. 2, 1981

[51] Int. Cl.[3] ..... C10M 3/18

[52] U.S. Cl. ..... 252/42; 252/49.3; 252/49.5

[58] Field of Search ..... 252/42, 49.3, 49.5

[56] References Cited

U.S. PATENT DOCUMENTS

| | | | |
|---|---|---|---|
| 2,735,814 | 2/1956 | Hodson et al. | 252/30 |
| 2,921,874 | 1/1960 | Kubie | 148/6.14 |
| 2,959,547 | 11/1960 | Brillhart | 252/49.3 X |
| 3,209,453 | 10/1965 | Bertoglio et al. | 72/354 |
| 3,313,729 | 4/1967 | Glasson | 252/18 |
| 3,375,193 | 3/1968 | Ruzza et al. | 252/23 |
| 3,507,791 | 4/1970 | Teeter et al. | 252/34.7 |
| 3,806,453 | 4/1974 | McDole | 252/49.5 X |
| 3,962,103 | 6/1976 | Johnston et al. | 252/22 |
| 3,983,042 | 9/1976 | Jain et al. | 252/18 |
| 4,088,585 | 5/1978 | Karpen | 252/28 |
| 4,149,983 | 4/1979 | Grier et al. | 252/49.5 |
| 4,287,073 | 9/1981 | Jain et al. | 252/49.3 X |
| 4,289,636 | 9/1981 | Davis et al. | 252/49.5 X |

FOREIGN PATENT DOCUMENTS

| | | |
|---|---|---|
| 721255 | 1/1955 | United Kingdom . |
| 856924 | 12/1960 | United Kingdom . |
| 995708 | 6/1965 | United Kingdom . |
| 2017750A | 10/1979 | United Kingdom . |
| 2046298A | 11/1980 | United Kingdom . |

*Primary Examiner*—Andrew Metz

[57] ABSTRACT

A lubricant composition for hot forging operations is disclosed which includes water and phthalates made by reacting phthalic acids with alkali metal hydroxides. Other additives may be present such as thickeners, extreme pressure (E.P.) additives, suspending agents, germicides, anti-wear agents, pigments, corrosion inhibitors, wetting agents, dyes, and perfumes. A hot forging process based on the above lubricant is also disclosed.

18 Claims, No Drawings

SYNTHETIC HOT FORGING LUBRICANTS AND PROCESS

BACKGROUND OF THE INVENTION

Hot forging is a process by which the shape and physical properties of metal can be changed. The process involves placing a piece of metal (normally heated) between the halves of a die and forcing the die to close by impact or pressure. The operation causes a controlled plastic deformation of the metal into the cavities of the die. This flow of material results not only in a change in shape of the metal but also increases the density and uniformity of the metal, improves its grain structure, and causes a shape-conforming grain flow. The resulting workpiece has properties which are superior to those generated by other methods, making forging essential where high performance workpieces are required.

One of the critical components of a forging system is the lubricant which separates the die from the workpiece. As with all lubricating situations, it is essential that this lubricant be effective to minimize wear of the extremely expensive forging dies and minimize expenditure of energy over a wide range of conditions.

The lubricant must also assure a high quality surface on the forging and not leave objectionable residues or corrosion on the dies.

As modern demand for safer and more dependable machine structures increases, the forging art is being applied to more difficult materials at higher temperatures and pressures to form more complex shapes. Although oil-based lubricating compositions, which are effective under these extreme conditions, have been developed, their properties are found to conflict seriously with national commitments to personal safety and protection of the environment. The oil-based lubricants are normally flammable under and can ignite well below common operating temperatures. Normal operation results in billowing carbonaceous smoke which is unpleasant and sometimes toxic. Furthermore, cleaning of the workpieces and dies requires solvent washes that produce large quantities of rinse, which, because of the economics of recycling and the desire to protect the environment, can present serious disposal problems.

The ecological problems associated with oil-based hot forging lubricants have led to the development of water-based compositions. One obvious advantage of a water-based lubricant composition is that die cooling can be accomplished by water evaporation on the hot dies, often making separate water cooling of the dies unnecessary. Early attempts directed to water-based compositions involving graphite, clay minerals, iron oxide and molybdenum disulfide E.P. and anti-wear additives were often ineffective because the water did not adequately wet the hot die surfaces.

One of the early disclosures of water-based lubricants is U.S. Pat. No. 2,735,814 wherein a die forging lubricant contained fish oil, graphite and water. The patentee in U.S. Pat. No. 2,921,874 employed fatty acids, combined with an organic acid reactant, such as phthalic acid, a solvent and water as lubricants for cold forming operations.

The patentee in U.S. Pat. No. 3,313,729 discloses a mixture of pyrophosphate or sodium tetraborate and a fatty acid soap of 8 to 22 carbon atoms, preferably 12 to 18 carbon atoms, to form a dry coating on the metal article prior to cold forging. A similar dry coating lubricant is disclosed in U.S. Pat. No. 3,375,193 based on a water soluble colloid, a fatty acid soap having 12 to 22 carbon atoms, an alkali metal tartrate and inorganic pigments.

A glass-forming lubricant is disclosed in U.S. Pat. No. 3,507,791 comprising an aqueous dispersion of a monocarboxylic acid of 10 to 32 carbons, an alkanolamine, a water soluble alcohol and water. The patentee in U.S. Pat. No. 3,983,042 discloses a water-based lubricant for hot forging containing graphite, organic thickener, sodium molybdate and sodium pentaborate.

From the above disclosures, it is apparent that fatty acids and fatty acid soaps have been widely used as anti-wear and lubricant additives in forging compositions. These fatty acids and soaps have generally been preferred in the $C_8$ to $C_{20}$ range. More recently, the Metalprep Department of Pennwalt Corporation has marketed hot forging lubricants containing the alkali metal salt of either azelaic or adipic acid in aqueous solution. Adipic acid salt compositions readily wet the dies at elevated temperatures, e.g., 600°-800° F., are relatively free from smoke and fumes and are stable at elevated temperatures up to about 700° F. At hot forging die temperatures of up to 900° F. (and metal workpiece temperatures of 1200° F. and above) the lubricants normally decompose during the forging process. The importance of providing lubricants with higher temperature stability is to delay decomposition so as to achieve the necessary lubrication before decomposition occurs.

I have now discovered lubricant compositions and a process of hot forging ferrous and non-ferrous metals which provide improved performance with respect to wettability temperature (up to about 900° F.), stability temperature (up to about 800° F.) and lubrication as compared with adipic acid salt compositions.

BRIEF SUMMARY OF THE INVENTION

In accordance with this invention there is provided hot forging lubricant compositions which include aqueous solutions of alkali metal salts of phthalic acids as well as a hot forging process utilizing the lubricants which are applied to the surfaces of the forging dies. The lubricant compositions can also include additives such as thickening agents and preservatives.

DETAILED DESCRIPTION OF THE INVENTION

The lubricating compositions and forging processes of my invention are based on aqueous solutions and dispersions (where insoluble materials such as pigments are present) in which phthalic acid salts are the principal lubricating agents. The salts can be formed by combining the acid, which can be any of the three isomers of phthalic acid which are: orthophthalic acid, isophthalic acid and terephthalic acid, with alkali metal hydroxides, for example sodium, potassium and lithium hydroxide, in water in equivalent proportions to neutralize both carboxylic acid groups. It is preferred that the pH of the resulting solution be in the range of about 7.0 to 8.0 in order to optimize the thermal stability, wettability and lubrication properties of the compositions. Although the pH range is not particularly critical with respect to the lubricating properties of the compositions, the presence of free acid or alkali may cause problems with respect to corrosion, odor and handling and should be avoided (pH less than about 5 or greater than about 10). The amount of salt in the concentrated solution ranges from about 5 to 35 percent by weight of the composition. The upper limit of the range is governed by the solubility of the salt and the lower limit by practical considerations of packaging and shipping costs. Certain metal salts are more soluble in water and are, therefore, preferred. The working solution salt concentration will depend upon the particular forging process conditions and generally will range from about 0.5 to 25 percent by weight of the composition. Mixtures of salts can also be used in the compositions.

Thickening agents are normally employed with the lubricant compositions and process of the invention to enhance wetting of the hot forging dies and to provide additional lubrication.

Suitable organic thickeners include water dispersable modified celluloses such as, methyl cellulose, water soluble ether cellulose, sodium carboxymethyl cellulose, ammonium carboxyethyl cellulose, methylethyl cellulose, hydroxymethyl cellulose, hydroxyethyl cellulose, potassium carboxyhexyl cellulose, sodium cellulose glycollate, carboxypropyl cellulose, and cellulose acetate. Casein and alginates such as sodium alginate are satisfactory thickeners.

Other suitable water soluble thickeners include polymethacrylates, polyvinyl alcohol, starches, modified starches, gelatin, natural gums such as gum arabic and polysaccharides.

A preferred organic polymer thickener is hydroxyethyl cellulose which is commercially available from Hercules Chemical under the trademark Natrosol 250 HR and 250 HHR. The thickeners are employed in amounts of from about 0.1 to 25.0 percent by weight of the concentrated composition and from about 0.005 to 25 percent by weight of the working strength solution.

Inorganic materials such as bentonite are also satisfactory for use as thickeners.

It is desirable to include germicide(s) in the aqueous lubricants to prevent the growth of bacteria and biodegradation of the thickening agents during storage and shipment of the concentrated lubricants as well as during storage of the dilute aqueous working strength solutions in the feed tanks. Suitable germicides include, for example, Dowicil 75, (mixture of 67.5% 1-(3-chloroallyl)-3,5,7-triaza-1-azoniaadamantane chloride and 23% sodium bicarbonate) and sodium omadine. Amounts of about 0.0005 to 0.1 percent by weight of the working strength composition of germicide are effective.

Other additives can be used as is conventional in forging lubricants such as surface active agents (including suspending agents, dispersing agents, wetting agents and emulsifying agents), E.P. additives, corrosion inhibitors, anti-wear agents, pigments, dyes, and perfumes.

Surface active agents are advantageously employed in the aqueous system to assist in wetting the surface of the dies and, in some cases, the forgings with the lubricating compositions. They also are used to disperse, suspend or emulsify the water insoluble components, such as graphite, when they are present, and to level the lubricant composition on the forging pieces and dies. The wetting agents, dispersing agents, and emulsifying agents for aqueous systems are well-known in the art. Many examples of each type are disclosed in McCutcheon's *Detergents and Emulsions,* 1981 Edition, which is incorporated herein by reference.

Suitable wetting, dispersing and/or emulsifying agents are those which in use produce minimual quantities of smoke and fumes and which have low foaming properties. Anionic agents are preferred. Examples of such agents include sodium salts of naphthalene sulfonic acids, sodium ligno sulfonate, sodium methylnaphthalene sulfonate and sodium salts of polyfunctional oligomers such as are marketed by Uniroyal under the mark Polywet ND-1 ®.

When used, a preferred concentration range of surface active agents in my compositions is from about 0.005 to 5.0 percent by weight of the working strength composition.

For difficult forgings under very high pressures, it sometimes is desirable to include E.P. additives such as molybdenum disulfide, and sodium molybdate.

Other additives may be used in my lubricating compositions in more severe forging operations to enhance lubrication, to act as a parting agent and to assist in controlling the temperature of the dies by acting as an insulator. Suitable additives include pigments and water soluble materials such as alkali metal salts of borates, silicates, phosphates and carbonates. Graphite is the most commonly used pigment. Other suitable pigments which may be used include lithopone, talc, calcium carbonate, zinc oxide, zinc carbonate, mica, magnesium carbonate and titanium dioxide. When such lubricant enhancers are present, they are used in amounts of from about 0.05 to 50 percent by weight of the working strength composition.

Corrosion inhibitors useful in my invention include: sodium molybdate, sodium benzoate and alkali metal nitrites. Benzotriazole is effective to prevent copper corrosion. When used, a preferred concentration of corrosion inhibitor is from about 0.05 to 5.0 percent by weight of the working strength composition. The amount needed will depend upon the method of application and use concentration with more needed where the forging equipment is exposed to the solution for longer periods of time, e.g., application by recirculation.

Dyes can serve several useful functions in my aqueous lubricants for hot forging. For example, they are an identifying agent to indicate the supplier of the lubricant. Dyes can also be used to indicate the pH of the aqueous solutions where this is important. Orcoacid alphazurine 2G dye, Blue dye, and Medford Chemical's Green dye are satisfactory. The inclusion of perfume is purely for esthetic purposes. Dyes and perfumes are added in amounts to please the senses.

The aqueous hot forging lubricants of my invention are supplied in a concentrated form and the lubricants may be used in the neat concentration for the most difficult forging operations. In other less difficult forgings, the concentrated lubricant may be diluted with water to fit the particular forging needs. The amount of dilution can only be determined by actual operation of the forging press on the particular work piece. Generally, dilutions with up to about 50 volumes of water to 1 volume of the concentrated lubricant are employed.

The lubricant compositions may be formulated as described below. A vessel equipped with stirrer and with either interior or exterior heating and cooling is preferred. Stainless steel is a preferred metal for the mixing vessel. The vessel is charged with cold water and the organic thickener is added with stirring until dissolved. Next, the main portion (about 90%) of the alkali metal hydroxide is added followed by the phthalic acid. The temperature is allowed to rise to its natural level and, if necessary, heat is applied to complete the reaction. The final portion of alkali metal hydroxide is added until the acid number is between about 0.0 and 0.3 (a free acid content of 0 to 0.05). For best results, the solution should not contain any significant amounts of free acid or alkali. Finally, the preservative is added as well as any of the other conventional lubricating additives as may be required. The final solution will be a clear liquid with a semi-gelled or viscous appearance.

The preformed dimetal salt of the acid could be added to water although it is more convenient to form the salt in situ by the above salt formation process. The surface active agents such as dispersants, wetting agents and emulsifying agents are usually added before the graphite and after the thickener.

The lubricant compositions described above can be applied to the forging dies in any convenient manner such as by immersion, by swab, by recirculation of the lubricant over the dies or by spraying. Application by spraying is the most efficient application method. The forging process consists of applying an effective amount of the lubricant to the dies, placing the workpiece between the dies, applying pressure to the dies, opening the dies and removing the forging. The effective amount is a lubricating amount. This quantity can only be determined by actual trial conditions since the effective amount of lubricant required will depend on many variables such as temperature level, forging pressure, hardness of the workpiece, degree of difficulty of the forging, the time required for forging and other factors. The forging processes can include the forging of ferrous metals such as steel and non-ferrous metals such as copper and aluminum.

The invention is further illustrated by, but is not intended to be limited to, the following examples wherein parts are parts by weight unless otherwise indicated.

EXAMPLE 1

An aqueous concentrated lubricant solution was formed by the procedure described above using the following proportions of ingredients which are listed in the order of addition:

| Ingredient | Percent by Weight |
|---|---|
| Water | 74.4 |
| Hydroxyethylcellulose (HEC) | 1.0 |
| Sodium Hydroxide (50% aqueous solution) | 12.0 |
| Isophthalic acid (IPA) | 12.5 |
| Germicide (Dowicil 75) | 0.1 |

The stability temperature of the composition was determined by diluting it 1:1 by volume with water and placing a drop on a steel panel heated by a hotplate. The material formed a white powder at about 800° F. which softened and then slightly discolored. A comparable formulation, but containing disodium adipate instead of isophthalate, softened at 700° F.

In examples 2–9, a series of lubricants were formulated having the following proportions of ingredients listed in the order of addition:

EXAMPLE 2

| Ingredient | Percent by Weight |
|---|---|
| Water | 67.9 |
| HEC | 1.0 |
| KOH (45% aqueous solution) | 18.5 |
| IPA | 12.5 |
| Germicide (Dowicil 75) | 0.1 |

EXAMPLE 3

| Ingredient | Percent by Weight |
|---|---|
| Water | 80.1 |
| HEC | 1.0 |
| $LiOH.H_2O$ | 6.3 |
| IPA | 12.5 |
| Germicide (Dowicil 75) | 0.1 |

EXAMPLE 4

| Ingredient | Percent by Weight |
|---|---|
| Water | 67.1 |
| HEC | 1.0 |
| NaOH (50% aqueous solution) | 9.45 |
| IPA | 10.0 |
| Lubricant aid | |
| Borax and | 10.0 |
| Phosphoric Acid (75% aqueous) | 2.45 |
| Germicide Dowicil 75 | 0.05 |

EXAMPLE 5

| Ingredient | Percent by Weight |
|---|---|
| Water | 53.73 |
| NaOH (50% aqueous solution) | 14.15 |
| IPA | 15.00 |
| Germicides | |
| Sodium Omadine (40% aqueous) | 0.02 |
| Dowicil 75 | 0.1 |
| Wetting Agent | 1.0 |
| Polywet ND-1 (Sodium salt of a polyfunctional oligomer) | |
| Graphite (amorphous 35 micron) | 15.0 |
| HEC | 1.0 |

EXAMPLE 6

| Ingredient | Percent by Weight |
|---|---|
| Water | 67.93 |
| Sodium Alginate | 1.5 |
| NaOH (50% aqueous solution) | 9.45 |
| IPA | 10.0 |
| Germicides | |
| Sodium Omadine (40% aqueous) | 0.02 |
| Dowicil 75 | 0.1 |
| Wetting Agent | 1.0 |
| Polywet ND-1 (Sodium salt of a polyfunctional oligomer) | |
| Graphite | 10.0 |

EXAMPLE 7

| Ingredients | Percent by Weight |
|---|---|
| Water | 67.8 |
| HEC | 1.0 |
| KOH (45% aqueous solution) | 18.6 |
| Terephthalic acid (TPA) | 12.5 |
| Germicide (Dowicil 75) | 0.1 |

When tested for softening as described in Example 1, a softening point of about 800° F. was observed.

EXAMPLE 8

| Ingredients | Percent by Weight |
|---|---|
| Water | 75.84 |
| HEC | 1.0 |
| NaOH (50% aqueous solution) | 11.84 |
| Phthalic Anhydride (PA) (yields 12.5% orthophthalic acid) | 11.22 |
| Germicide (Dowicil 75) | 0.1 |

When tested for softening as described in Example 1, the composition had a softening point between 600°-650° F. with some discoloration. However, the material stayed greasy longer at 800° F. than the comparable disodium adipate composition which is indicative of better high temperature lubricant properties.

EXAMPLE 9

| Ingredients | Percent by Weight |
|---|---|
| Water | 69.3 |
| HEC | 1.0 |
| KOH (45% aqueous solution) | 18.4 |
| PA | 11.2 |
| Germicide (Dowicil 75) | 0.1 |

EXAMPLES 10-12

The composition of Example 1 was prepared except that there was added 1.0, 1.25, and 1.5 percent by weight of the corrosion inhibitor $NaNO_2$.

EXAMPLE 13

The third stage hot finish dies (300°-500° F.) of a 2500 ton mechanical press were sprayed with the lubricant composition of Example 1 at a dilution of 5 to 1 by volume of water to composition so as to coat the surfaces of the dies with a white powdery coating. A steel billet at a temperature of about 2250°-2300° F. was placed between the preceding second stage extruding dies and preformed with a graphite containing oil based lubricant. The billet was then placed between the lubricant coated finish dies and compressed with one stroke into a front wheel spindle for an automobile. The lubricant composition of the invention performed well with no smoke, fire, or fumes which occurred in the preceding stage using the oil based lubricant. The aqueous lubricant of Example 1 gave good wetting and coverage of the finish dies and no clogging of the spray nozzles.

EXAMPLE 14

The hot dies of a 12,000 pound hammer were sprayed with the 5 to 1 diluted composition of Example 1 which produced a white powdery coating on the dies. A steel billet at a temperature of about 2350° F. was placed between the dies and after 6 to 8 hammer blows was successfully forged into a curved I beam support spar for an aircraft.

EXAMPLE 15

The hot dies of a 14,000 pound hammer were sprayed with the 5 to 1 diluted composition of Example 1 and a steel billet at a temperature of about 2375° F. was successfully forged with 24 blows into a large, donut shaped gear blank for a tractor.

A limited attempt to form a 10 inch deep stainless steel rotating component for a turbine engine with a hammer resulted in some lower die sticking, which is believed to be due to the lack of knock out pins in the die and the absence of sufficient lubricant gassing which occurs with oil based lubricants.

EXAMPLE 16

The last two of the four sets of dies in a seven inch upsetter were sprayed with a 4 to 1 dilution of the composition of Example 1 to form a white coating on the dies. A billet at 1800° F. was placed between its dies and successfully forged into an axle shaft.

I claim:

1. A hot forging lubricant comprising an aqueous composition containing from about 0.5 to 35 percent by weight of composition of a dialkali metal salt of a phthalic acid and from about 0.005 to 25.0 percent by weight of composition of a thickening agent.

2. The composition of claim 1 wherein the composition contains from about 5 to 35 percent by weight of said salt.

3. The composition of claim 1 wherein the alkali metal is selected from the group consisting of potassium, sodium and lithium.

4. The composition of claim 1 wherein the pH is from about 5 to 10.

5. The composition of claim 4 wherein the pH is from about 7 to 8.

6. The composition of claim 1 wherein the salt is disodium isophthalate.

7. The composition of claim 1 wherein the salt is dipotassium terephthalate.

8. The composition of claim 1 wherein the acid is selected from the group consisting of orthophthalic acid, isophthalic acid, terephthalic acid and mixtures thereof.

9. A hot forming lubricant comprising an aqueous composition containing conventional aqueous lubricant additives, the improvement comprising including in the composition from about 0.5 to 35 percent by weight of composition of a dialkali metal salt of a phthalic acid and from about 0.005 to 25.0 percent by weight of composition of a thickening agent.

10. The composition of claim 9, including from about 0.0005 to 0.1 percent by weight of composition of a germicide.

11. The composition of claim 9 including from about 0.05 to 50 percent by weight of a lubricant enhancer.

12. The composition of claim 11 including from about 0.005 to 5.0 percent by weight of a surface active agent.

13. The composition of claim 9 wherein the thickening agent is an organic polymer.

14. The composition of claim of claim 13 wherein the thickening agent is hydroxyethyl cellulose.

15. The composition of claim 9 including from about 0.05 to 5.0 percent by weight of a corrosion inhibitor.

16. A hot forging process for metals comprising applying to hot forging dies an aqueous lubricant composition containing from about 0.1 to 35 percent by weight of composition of a dialkali metal salt of a phthalic acid and from about 0.005 to 25.0 percent by weight of composition of a thickening agent, placing the metal between the dies, closing the dies under pressure, opening the dies and removing the forged metal.

17. The process of claim 16 wherein the lubricant composition is applied to the die by spraying.

18. A hot forming process for metal comprising applying an aqueous lubricant composition containing from about 0.5 to 35 percent by weight of composition of a dialkali metal salt of a phthalic acid to the surface of a hot die, placing the metal in the die to form the metal into the shape of the die, and removing the shaped metal from the die.

* * * * *